US006168035B1

(12) United States Patent
McLelland

(10) Patent No.: US 6,168,035 B1
(45) Date of Patent: Jan. 2, 2001

(54) CHILD-RESISTANT THREADED CLOSURE

(75) Inventor: Douglas M. McLelland, Ft. Wayne, IN (US)

(73) Assignee: Rieke Corporation, Auburn, IN (US)

( * ) Notice: Under 35 U.S.C. 154(b), the term of this patent shall be extended for 0 days.

(21) Appl. No.: 09/304,732

(22) Filed: May 4, 1999

(51) Int. Cl.[7] ..... B65D 50/02
(52) U.S. Cl. ..... 215/216; 215/43; 215/44
(58) Field of Search ..... 215/215, 216, 215/217, 218, 219, 220, 43, 44, 330

(56) References Cited

U.S. PATENT DOCUMENTS

| | | | | |
|---|---|---|---|---|
| 3,450,289 | | 6/1969 | Esposito, Jr. . | |
| 3,642,161 | | 2/1972 | Stroud . | |
| 3,877,597 | | 4/1975 | Montgomery et al. . | |
| 3,917,097 | | 11/1975 | Uhlig . | |
| 3,989,152 | | 11/1976 | Julian . | |
| 3,993,208 | | 11/1976 | Ostrowsky . | |
| 4,036,385 | | 7/1977 | Morris . | |
| 4,572,385 | | 2/1986 | Luker . | |
| 4,865,209 | | 9/1989 | Bush . | |
| 5,165,559 | | 11/1992 | Kusz . | |
| 5,383,564 | | 1/1995 | Hamilton et al. . | |
| 5,460,281 | | 10/1995 | Rapchak et al. . | |
| 5,586,671 | | 12/1996 | Thomas et al. . | |
| 5,671,853 | | 9/1997 | Herr . | |
| 5,687,863 | * | 11/1997 | Kusz | 215/216 |
| 5,706,963 | | 1/1998 | Gargione . | |
| 5,722,546 | | 3/1998 | Briere . | |
| 5,727,703 | | 3/1998 | Fuchs . | |
| 5,865,330 | * | 2/1999 | Buono | 215/219 X |
| 5,918,752 | * | 7/1999 | Meyer | 215/219 X |

* cited by examiner

*Primary Examiner*—Allan N. Shoap
*Assistant Examiner*—Joe Merek
(74) *Attorney, Agent, or Firm*—Woodard, Emhardt, Naughton, Moriarty & McNett

(57) ABSTRACT

A closure cap for use in combination with a container outlet is configured with a child-resistant feature involving a pair of abutment projections formed as part of the container outlet and a pair of abutment ribs formed as part of the closure cap. The container outlet is externally threaded and includes a dispensing opening. The container outlet also includes an annular skirt which provides a support surface for the pair of abutment projections. The closure cap is internally threaded and the pair of spaced-apart abutment ribs are designed to ride over each abutment projection during the threaded advance of the closure cap onto the container outlet. During retrograde rotation of the closure cap from the container outlet, the abutment ribs are designed to abut up against the abutment projections. The abutment ribs are manually movable in a radially inward direction for taking each abutment rib out of abutting engagement with a corresponding abutment projection. In a typical embodiment, the spacing between abutment projections is 160 degrees/200 degrees and the spacing between the pair of abutment ribs is likewise 160 degrees/200 degrees. The thread pitch and the axial height of the abutment ribs and abutment projections are constructed and arranged so as to require a two-step removal procedure. By placing the abutment ribs on spacing other than 180 degrees/180 degrees, the teeth of a young child cannot be used to defeat the child-resistant features.

10 Claims, 5 Drawing Sheets

CHILD-RESISTANT THREADED CLOSURE

BACKGROUND OF THE INVENTION

The present invention relates in general to child-resistant closing caps and closures which are designed for closing off the dispensing outlet of a container where access to the contents within the container by young children is to be limited or restricted in some fashion. More specifically the present invention relates to such child-resistant closures which are threaded and designed for a two-step removal procedure. The removal procedure generally involves the manual release of abutting or engaging tabs and portions. Related aspects of the present invention involve structural configurations which are specifically designed to restrict the ability of a young child to remove the closure by using his or her teeth. These aspects of the present invention can be utilized with or without the two-step removal procedure.

A variety of child-resistant closures are known to exist, some of which include threaded caps which cooperate with a corresponding container so as to prevent removal of the cap without first performing a manual manipulation which is intended to disengage a portion of the cap from a portion of the container. For example, in U.S. Pat. No. 3,989,152 which issued Nov. 2, 1976 to Juilian, child-resistant locking means are provided as part of a twist-action cap for a container, the locking means having two cooperating parts. There is an abutment on the container near, but spaced radially from, the container neck and a tab on the cap which engages the abutment and prevents retrograde rotation of the cap. The tab is flexed inwardly in order to be moved past the abutment, both when the cap is screwed onto the container neck and when it is desired to remove the cap from the container neck. In other closure designs, inner and outer closure sidewalls are used to provide the child-resistant feature.

When ratchet or abutment portions on the closure and container are used to provide the child-resistant feature, they are typically positioned 180 degrees apart. The two-step removal procedure for these designs typically involves the concurrent, manual release of one or more abutting or engaging portions between the closure and the container followed by retrograde rotation of the closure followed by a second (concurrent) manual release manipulation. The key is to size one or more of the abutting or engaging portions with an axial height suitable to cause a second abutment after closure rotation, typically 180 degrees. The thread pitch of the closure and container also needs to be compatible with this intent, since the pitch controls how much axial movement there is of the closure relative to the container outlet during the 180 degrees of closure rotation.

What has been discovered is that with some smaller diameter closures, young children can span the closure outside diameter with their teeth. The upper and lower teeth of a young child, when placed around the diameter of the closure, are roughly 180 degrees apart and accordingly would likely be aligned with the oppositely-disposed child-resistant features on the closure. It is therefore a possibility that a young child could unintentionally release the abutment or engagement of the closure from the container when using the teeth to try and remove the closure from the container. If a two-step removal procedure is designed into the closure-container combination, then the child has to rotate the closure and repeat the release procedure.

In order to improve on the design of child-resistant closure/container systems of the type described with 180 degree spacing for the abutment or engagement features, the present invention provides staggered spacing of 160–200 degrees for the child-resistant features. In this way, the teeth of a young child, which will typically be 180 degrees apart when grasping the outside diameter of the closure, will not be aligned with the child-resistant features due to the 20 degree offset. On larger closures, children may use their teeth to try and pry the closure off of the container, but with these larger diameter closures, it will be assumed that the closure cannot be gasped between the upper and lower teeth. There are actually two embodiments available for incorporating the 160/200 degree spacing. The abutment tabs on the container and the tabs on the cap can both be set at a spacing of 160/200 degrees. Alternatively, one of these two structural members can be designed with 180/180 degree spacing while the other member includes the 160/200 degree spacing. However, only when both structural members are at the same spacing will a simultaneous double release be required. The preferred staggered spacing of 160/200 degrees for the closure is selected to be far enough away from 180/180 degrees that the teeth cannot engage both tabs, but close enough to permit relatively easy removal by adults.

As an added safeguard, the present invention incorporates a blocker bead located adjacent each child-resistant tab or abutment portion on the closure which tab needs to be manually depressed in order to release the closure and allow it to be removed from the container outlet. Any attempt by a young child to compress the child-resistant tab causes the corresponding and adjacent blocker bead to be contacted before the child-resistant tab is pushed radially inwardly far enough for release and this prevents the child-resistant tab from being released.

Based upon the design enhancements offered by the present invention, improvements are made to the state of the art for devices and designs of this type. What results is an improved child-resistant closure/container product.

SUMMARY OF THE INVENTION

A closure cap and container combination which includes a child-resistant feature according to one embodiment of the present invention comprises a container outlet and a closure cap. The container outlet includes an externally-threaded sidewall which defines a dispensing opening and an outer annular skirt which is positioned at the base of the sidewall. The closure cap is constructed and arranged for threaded assembly onto the container outlet for closing the dispensing opening, the closure cap including an internally-threaded outer wall which defines a hollow interior, a top surface for closing one end of the hollow interior, and a pair of circumferentially spaced-apart abutment ribs integrally formed as part of the outer wall, each abutment rib including a free end and being constructed and arranged for riding over each abutment projection during the threaded advance of the closure cap onto the outlet and for abutting engagement against a corresponding one of the abutment projections during attempted retrograde removal of the closure cap from the outlet, each of the pair of abutment ribs being manually movable in a radially inward direction for taking the corresponding abutment rib out of abutting engagement and wherein the circumferential spacing between the pair of abutment ribs in a clockwise direction is different from the circumferential spacing in a counterclockwise direction.

DESCRIPTION OF THE PREFERRED EMBODIMENT

Figure 1:
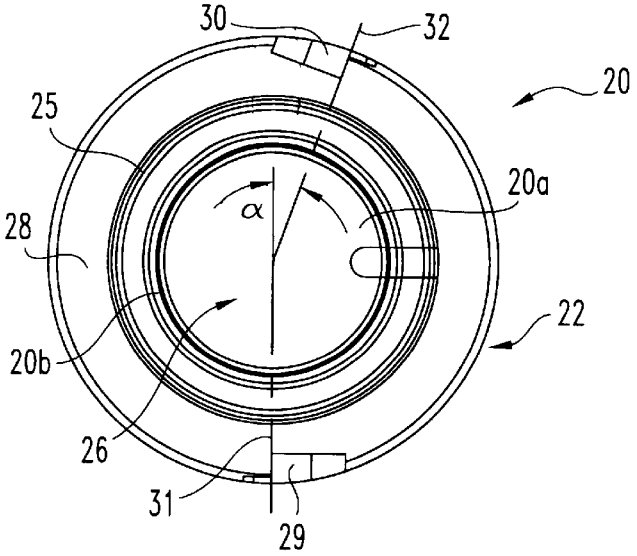
FIG. 1 is a top plan view of a container outlet which is styled to cooperate with a closure cap according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
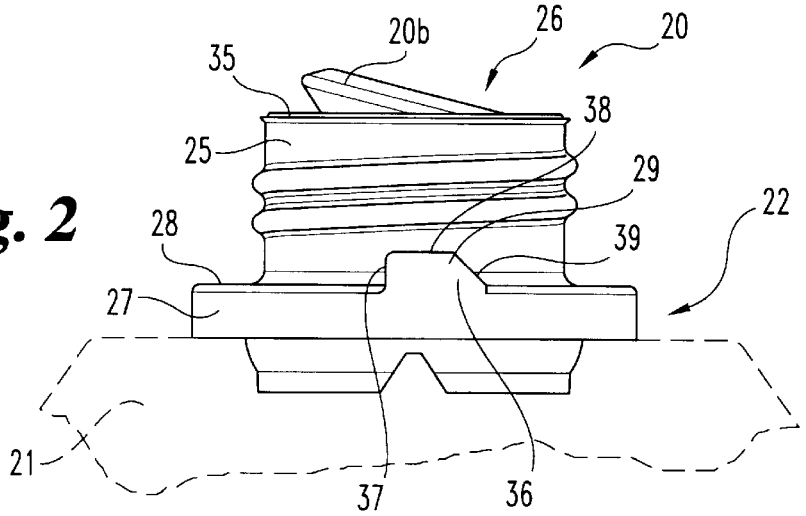
FIG. 2 is a front elevational view of the FIG. 1 container outlet.
Figure 3:
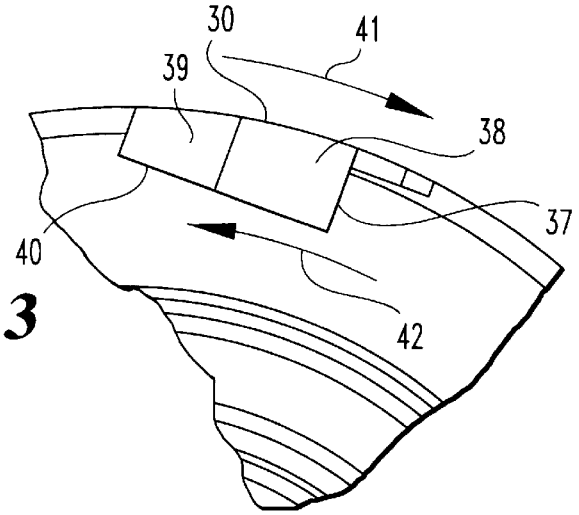
FIG. 3 is an enlarged top plan view of an abutment projection which comprises a portion of the FIG. 1 container outlet.

Referring to FIGS. 1, 2, and 3, there is illustrated a container outlet 20 which is generically styled to be attached to a cooperating container body 21 (partial phantom outline) in a secure and sealed fashion or alternatively may be molded as a integral portion of the container body. It is intended, consistent with the teachings of the present invention, that either configuration for the container outlet 20 will be acceptable. In the preferred embodiment, as illustrated in FIGS. 1, 2, and 3, the container outlet 20 has been configured as a separate component which is to be attached to the raised neck opening of a container, the contents of which are preferably not accessible to children without adult supervision and/or control.

Figure 4:
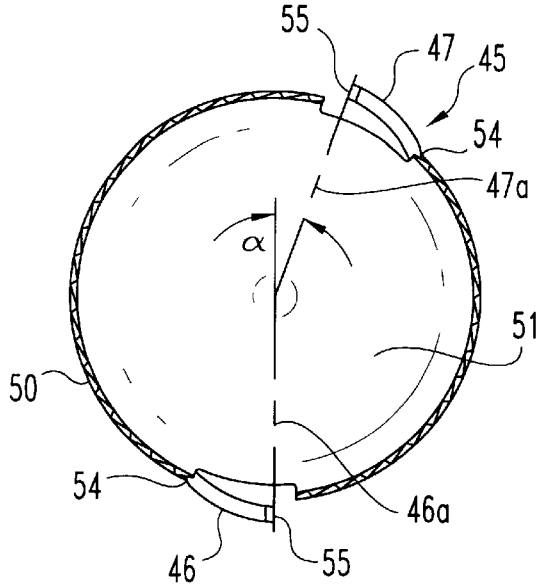
FIG. 4 is a top plan view of a closure cap which is styled to cooperate with the FIG. 1 container outlet according to the present invention.
Figure 5:
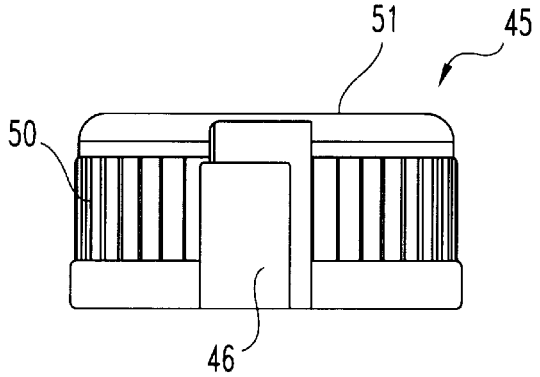
FIG. 5 is a front elevational view of the FIG. 4 closure cap.
Figure 6:
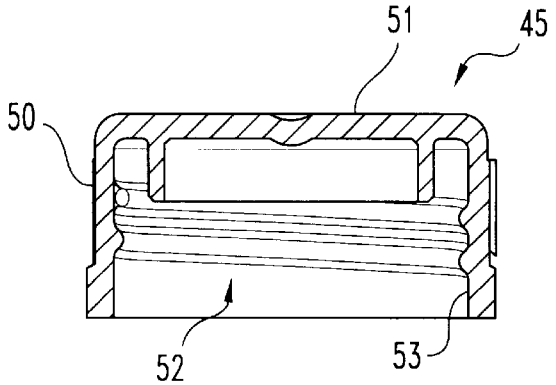
FIG. 6 is a front elevational view in full section of the FIG. 4 closure cap.
Figure 7:
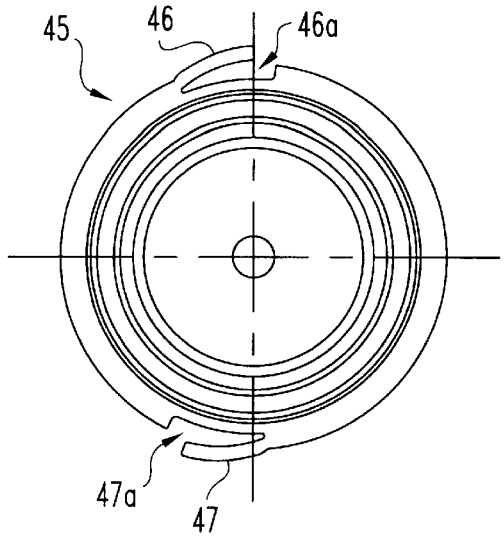
FIG. 7 is a bottom plan view of the FIG. 4 closure cap.

In the preferred embodiment, the container outlet 20 is styled as a unitary molded plastic dispensing spout with a tear-out diaphragm 20*a* and integral pull ring 20*b*. The lower edge portion 22 is constructed and arranged with an inverted, U-shaped channel for placing the outlet 20 on a raised annular rib (neck opening) of a container body. Various techniques are available to secure the outlet to the container body, including ultrasonic, friction fit, welding, heat fusion, adhesive bonding, and mechanical crimping. The outer cylindrical wall 25 of container outlet 20 is externally threaded for receipt of an internally-threaded closure cap 45 (see FIGS. 4, 5, and 6). The outer cylindrical wall 25 defines the dispensing opening 26 which exists once the tear-out diaphragm 20*a* is removed by pulling upwardly on pull ring 20*b*. The dispensing opening 26 is thereafter closed by the threaded assembly of cap 45 onto container outlet 20.

The outer annular skirt 27 which defines the inverted, U-shaped channel, includes as part of its upper surface 28 two integral abutment projections 29 and 30 which are located on 160 degree/200 degree spacing, using abutment edge lines 31 and 32, respectively. Angle alpha ($\alpha$) positions line 32 relative to the 180/180 degree centerline and in the illustrated embodiment alpha ($\alpha$) is 20 degrees. As should thus be clear, the clockwise distance from edge line 32 to edge line 31 is 160 degrees. The clockwise distance from edge line 31 to edge line 32 is 200 degrees. Using upper surface 28 as a frame of reference, and the upper edge 35 of opening 26 as being in an "upward" direction, each abutment projection 29 and 30 includes a lower portion 36 which is integral with upper surface 28, a vertical surface 37, a top surface 38, and an inclined surface 39. In FIG. 2 these three surfaces (37, 38, and 39) appear as edges. On the radially inward side of each abutment projection, a ramp portion 40 is provided which cooperates with and intersects with abutment surface 37 (see FIG. 3). Arrow 41 denotes the direction of advancing cap 45 rotation. Arrow 42 denotes the direction of retrograde rotation of cap 45 relative to container outlet 20.

Closure cap 45 is illustrated in FIGS. 4, 5, 6, and 7 and includes a pair of spaced-apart abutment tabs 46 and 47 which are located on 160 degree/200 degree spacing, using radial edge lines 46*a* and 47*a*, respectively, as the lines defining the circumferential interval or spacing between tabs 46 and 47. Angle alpha ($\alpha$) is 20 degrees in the illustrated embodiment. Cap 45 is a generally cylindrical, unitary molded plastic component with a substantially straight, annular sidewall 50 and a closed top 51. The sidewall 50 in cooperation with the closed top 51 define a hollow interior 52 which is constructed and arranged to receive outlet 20. The inside surface 53 of sidewall 50 is formed with integral threads having a size and pitch compatible with the external threads on the outer surface of cylindrical wall 25.

While sidewall 50 is described as annular and while cap 45 is described as generally cylindrical, the two abutment ribs 46 and 47 are integrally formed as part of sidewall 50. Each rib 46 and 47 has a slightly curved body joined at one end 54 to sidewall 50 while the opposite end 55 is free and designed to abut up against the abutment surface 37 of a corresponding abutment projection 29, 30. With 160 degree/200 degree spacing for both the closure cap and the container outlet, abutment engagement of free end 55 of abutment rib 46 against abutment surface 37 of abutment projection 29 occurs simultaneously with the same style of abutment engagement between the free end 55 of abutment rib 47 and surface 37 of abutment projection 30.

The threaded assembly of closure cap 45, i.e., threadedly advancing cap 45 onto outlet 20, causes each abutment rib 46 and 47 to ride up and over each ramp portion 40, causing radially inward deflection of each rib 46 and 47 as it passes each ramp portion 40. When attempting to threadedly remove (retrograde rotation) closure cap 45 from outlet 20, each rib 46 and 47, assuming alignment (i.e., overlap in a radial direction) with the corresponding abutment surface of each abutment projection, abuts against the abutment projection (i.e., end 55 against surface 37). The release technique is to manually deflect each rib in a radially inward direction so that there is no further abutment. This allows each rib 46 and 47 to move past each abutment projection 29 and 30. The recessed area 46*a* behind (i.e., inwardly of) rib 46 provides a clearance space for the radially inward movement of rib 46. A similar recessed area 47*a* is positioned behind rib 47 for providing the needed clearance space for rib 47.

The number of times this release step needs to be performed depends in part on the spacing intervals between the two abutment projections 29 and 30 and between the two ribs 46 and 47, and in part on the thread pitch. The thread pitch controls how much movement there is of the closure cap 45 in the axial direction with each revolution of the cap onto or off of the container outlet 20. The axial height of the two integral abutment projections 29 and 30 is also a consideration. There will of course be no abutment if the ribs 46 and 47 of closure cap 45 are axially elevated above the upper end of projections 29 and 30. The engagement of rib 47 (free end 55) against projection 30 (surface 37) is illustrated in FIG. 8.

Figure 8:
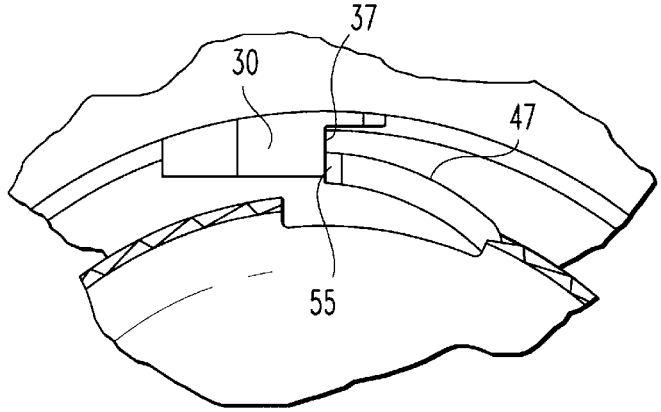
FIG. 8 is an enlarged top plan view of the engagement by an abutment tab of the FIG. 4 closure cap with the FIG. 3 abutment projection.
Figure 9:
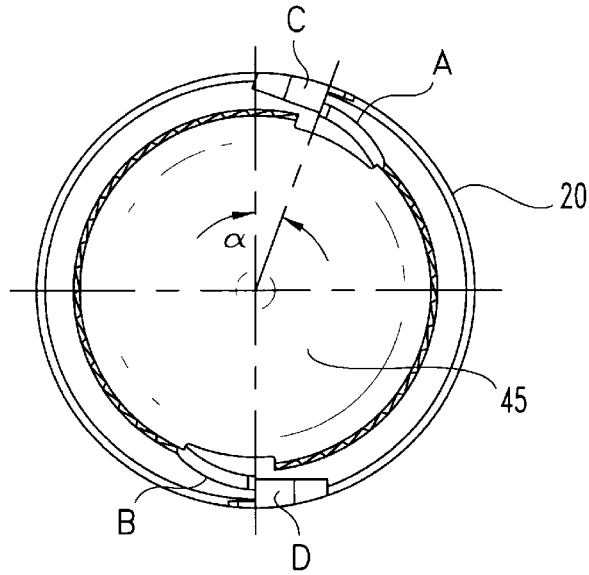
FIG. 9 is a digrammatic top plan illustration of the relationship between the two abutment tabs of the FIG. 4 closure cap and the two abutment projections of the FIG. 1 container outlet.

With reference to the diagrammatic illustration of FIG. 9, the mutual and concurrent abutment engagement between the closure cap and the container outlet as detailed in part by FIG. 8 is shown in full form. In FIG. 9, the two abutment ribs 47 and 46 and the two abutment projections 30 and 29 are identified as items or features A, B, C, and D, respectively. This shorthand lettering notation makes the explanation of the closure cap removal sequence a little easier to follow and should help with an explanation of the alternative embodiment as will be described hereinafter. In this embodiment, angle alpha ($\alpha$) measures 20 degrees.

When the closure cap is fully threaded onto the container outlet, ribs A and B are positioned relative to projections C and D such that the free end of A is adjacent the abutment surface of C and the free end of B is adjacent the abutment surface of D. If ribs A and B are pushed inwardly so as to concurrently release the abutment engagement with C and D, respectively, the closure cap can be rotated in a counterclockwise (retrograde) direction, thereby initiating the removal procedure of the closure cap from the container outlet. Once the projections C, D are cleared, the ribs A, B can be released and the closure cap is free to turn, until the next point of abutting engagement. Under the circumstances illustrated herein with regard to this particular embodiment, counterclockwise retrograde rotation of 160 degrees is permitted until rib B abuts up against projection C. This then requires the manual release of rib B from projection C. Thereafter, another 40 degrees of counterclockwise rotation positions rib A on projection D and rib B on projection C. The foregoing sequence would then repeat itself, but since the closure cap is axially moving away from upper surface 28 (see FIG. 2), the axial height of each abutment projection 29, 30 (D and C) may not be sufficient for rib A to engage projection D, after release of B from C and the additional rotation of 40 degrees. Whether or not there is continuing abutting engagement is a design choice which depends on the axial length or height of each rib 46 and 47, the position of each rib on the sidewall 50 of the closure cap 45, and the axial height of each abutment projection 29 and 30. Also involved in this design choice is the selected thread pitch which controls the axial distance of movement in each 360 degree rotation.

In the preferred embodiment, there is initial A to C and B to D engagement. Accordingly, both points of engagement need to be released concurrently. After 160 degrees of counterclockwise rotation of closure cap 45, there is abutting engagement of B on C. After release of B from C, the closure cap can be unthreaded without any further abutment engagement. Accordingly, in the preferred embodiment of FIGS. 1–8, there is a two-step removal procedure which means two separate release manipulations separated by a counterclockwise retrograde rotation. There is also provided a rib and projection spacing of something other than 180 degrees/180 degrees for the two abutment projections and for the two abutment ribs. Specifically, there is a 160 degree/200 degree spacing in the preferred embodiment which has been illustrated and described which applies to both the container outlet projections and the closure cap ribs or tabs. With regard to the preferred spacing, the selection of 160/200 degrees is a desirable compromise between 180/180 degrees spacing which includes the discussed risk of inadvertent opening by children using their teeth and something less than 160 and more than 200 (such as 120/240) which might prove more awkward to open for the elderly and arthritic users.

Figure 10:
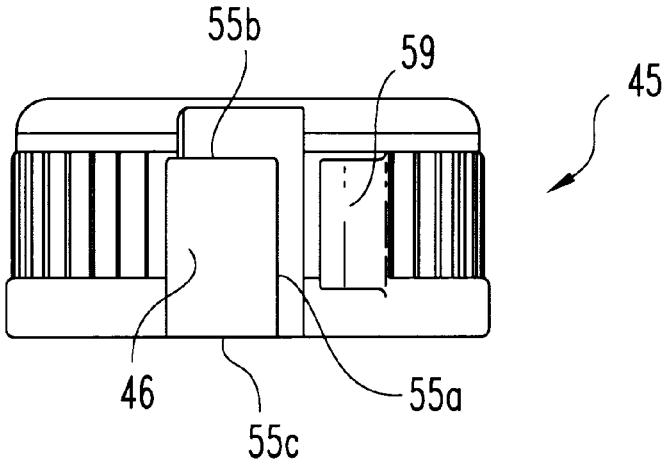
FIG. 10 is a front elevational view of the FIG. 4 closure cap with the addition of a blocker bead beside each abutment tab.
Figure 11:
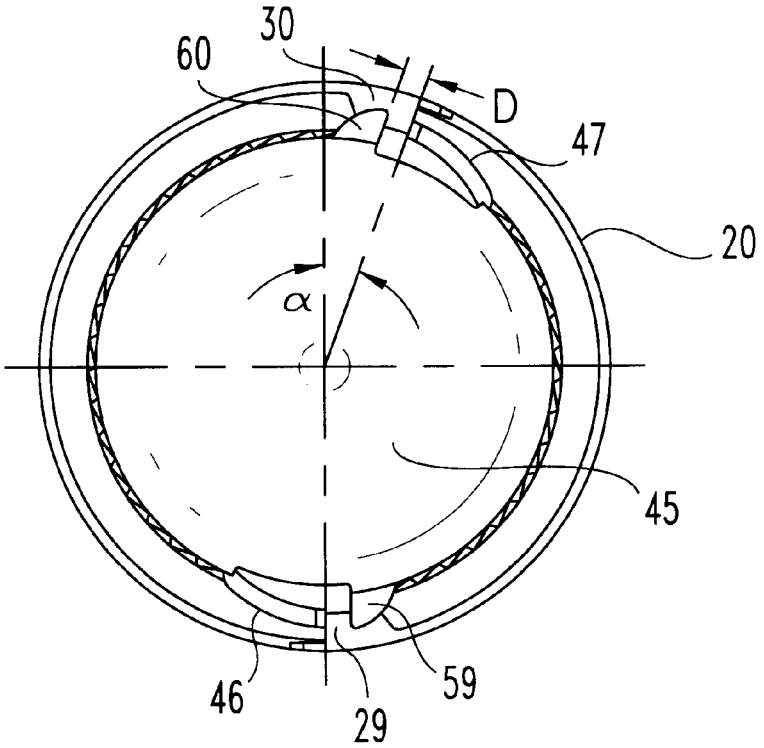
FIG. 11 is a top plan view of the FIG. 10 closure cap with the two blocker beads and the engagement of this closure cap with the FIG. 1 container outlet.

With continued reference to FIGS. 4–7, and with reference to FIGS. 10 and 11, another feature of the present invention is illustrated. In FIGS. 10 and 11 an additional structure has been added at two places on the cap 45. Adjacent to each abutment rib 46 and 47, there is located a blocker bead 59 and 60, respectively. Each blocker bead 59 and 60 is integrally molded as part of unitary closure cap 45 and is spaced from the free end 55 of the corresponding and adjacent abutment rib. The distance of separation (D) is approximately 2 mm (0.079 inches). Each blocker bead has an axial length of approximately 6 mm (0.236 inches) which extends substantially parallel to the straight axial edge 55*a* of end 55. Further, the axial length of each blocker 59 and 60 extends for a majority of the axial length of the corresponding abutment rib and is positioned between the upper and lower edges 55*b* and 55*c*, respectively. The radial distance of each blocker bead away from the outer surface of sidewall 50 measures approximately 1.5 mm (0.059 inches). However, the required radial dimension for each blocker bead 59 and 60 is a dimension which substantially coincides with the outer radial position of free end 55. In this manner, where there is an attempt to manually push in (radially inwardly) on free end 55, as part of the release manipulation, the adjacent blocker bead 59, 60 serves to block the movement of free end 55. In order to fulfill this design objective, it is important that the blocker bead be positioned close to the free end 55, have a sufficient axial length, and have an outward radial position which generally coincides with the radial position of the free end. If the axial length of the blocker bead is too short, it might be possible to release the free end 55 by a finger or by use of the teeth without interference with the blocker bead, such as placing the pressure point either above or below the blocker bead. If release of the closure cap from the outlet is attempted by a young child using his or her teeth, the blocker bead interferes and will preclude the radially inward movement of the abutment ribs. If the ribs cannot be pushed inwardly, the abutting engagement on the abutment projections cannot be released and the closure cap stays on the container outlet.

When an adult desires to remove the closure cap from the container outlet, it is possible to manipulate the abutment ribs 46 and 47 without interference with the blocker beads, but this requires a mental awareness of the issue and a sufficient level of manual dexterity to be able to properly manipulate the abutment ribs without interference with the blocker beads. Neither of these capabilities are likely possessed by young children. Consequently, the disclosed embodiment provides a child-resistant closure cap/container outlet combination.

Figure 12:
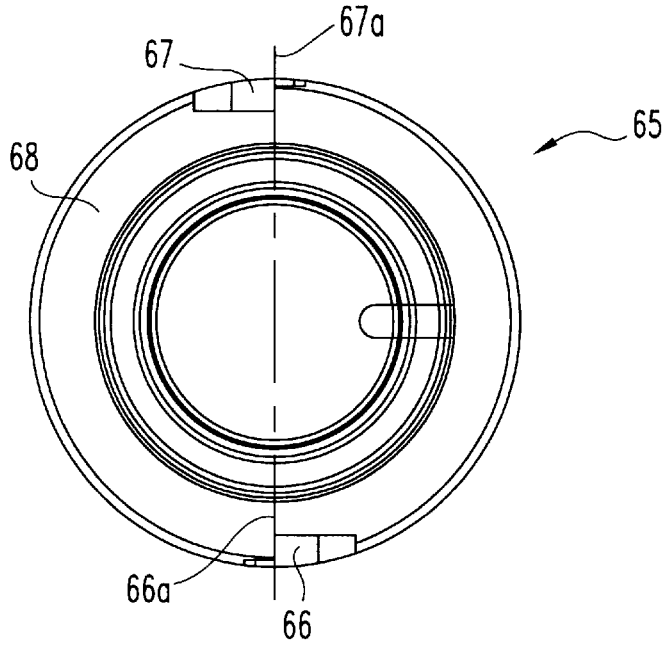
FIG. 12 is a top plan view of a container outlet which is styled to cooperate with a closure cap according to another embodiment of the present invention.

Referring now to FIG. 12, another embodiment of the present invention is illustrated. In the FIG. 12 embodiment, the container outlet 65 includes a pair of spaced-apart abutment projections 66 and 67 which are located on 180 degree spacing on the outer annular skirt 68. Coincident centerlines 66*a* and 67*a* denote the 180 degree spacing between these two abutment projections.

It is to be understood that container outlet 65 is identical to container outlet 20 with the exception of the circumferential spacing of the two abutment projections which is changed from a 160 degree/200 degree spacing to a 180 degree/180 degree spacing. Abutment projections 66 and 67 each have a size and shape identical to abutment projections 29 and 30. The only difference between this embodiment and the embodiment of FIGS. 1–8 is the spacing of the two abutment projections 66 and 67. Accordingly, closure cap 45 is used in combination with container outlet 65 for the second (FIG. 12) embodiment of the present invention. This means that the manner of abutting engagement against the abutment projections 66 and 67 by the abutment ribs 46 and 47 is the same in the second embodiment as in the first embodiment, except for the differences in the abutment sequence caused by the change in spacing of the two abutment projections 66 and 67.

Figure 13:
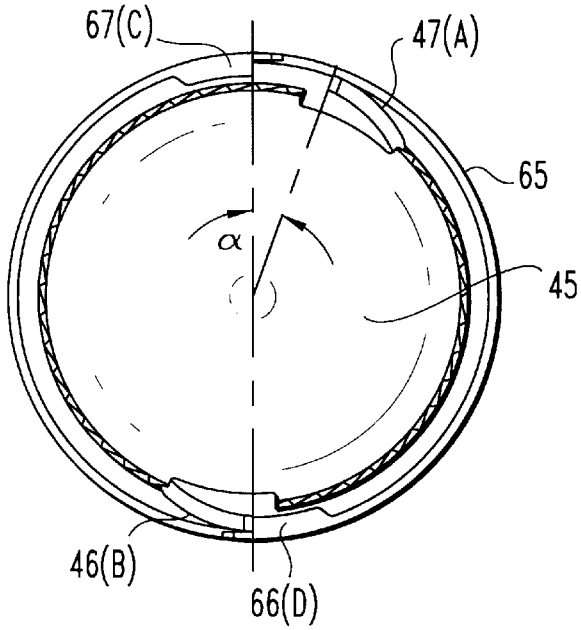
FIG. 13 is a diagrammatic top plan illustration of the relationship between the two abutment tabs of the FIG. 4 closure cap and the two abutment projections of the FIG. 12 container outlet.

With reference to FIG. 13, a diagrammatic illustration is provided along the same line as that provided by FIG. 9. The FIG. 13 illustration is included for the second embodiment of the present invention in order to explain the points of abutting engagement and the degrees of counterclockwise retrograde rotation between points of abutting engagement. With the closure cap 45 fully threaded onto the container outlet 65, abutment rib 46(B) is positioned against abutment projection 66(D), preventing removal of closure cap 45. Abutment rib 47(A) is spaced apart from abutment projection 67(C) by approximately 20 degrees.

The two-step removal procedure includes the manual release of B from abutment against D. Then, after 20 degrees of counterclockwise rotation of the closure cap 45 relative to the container outlet 65, A abuts up against C. Manual release of A and 160 degrees of counterclockwise rotation of the closure cap positions B on C. By selectively deciding on the axial dimension of each abutment projection relative to the size of each abutment rib and the thread pitch for the closure cap and container outlet, the number of individual release steps can be predetermined and controlled. In this second embodiment of the present invention, as illustrated by FIG. 12 and as diagrammatically explained in part by FIG. 13, three release steps are required separated by two counterclockwise rotations. Thereafter, the closure cap 45 has been moved to an axial height which is high enough above the abutment projections to avoid any further abutting engagement. This second embodiment of the present invention also includes the option of including virtually identical blocker beads 59, 60 as part of the closure cap 45 with the same use, functioning, and structural configuration and positioning as previously described for blocker beads 59 and 60.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

(a) an outlet for a container comprising:

an externally-threaded sidewall defining a dispensing opening, said sidewall having a base portion;

an outer annular skirt positioned at the base portion of said sidewall; and a pair of circumferentially spaced-apart abutment projections integrally formed as part of said outer annular skirt, each abutment projection including an abutment surface; and (b) a closure cap constructed and arranged for threaded assembly onto said outlet for closing said dispensing opening, said closure cap comprising:

an internally-threaded outer wall defining a hollow interior;

a top surface for closing one end of said hollow interior; and a pair of circumferentially spaced-apart abutment ribs integrally formed as part of said outer wall, each abutment rib including a free end and being constructed and arranged for riding over each abutment projection during the threaded advance of the closure cap onto the outlet and for abutting engagement against a corresponding one of said abutment projections during retrograde rotation of said closure cap from said outlet, each of said pair of abutment ribs being manually movable in a radially inward direction for taking the corresponding abutment rib out of abutting engagement, wherein the circumferential spacing between said pair of abutment ribs in a clockwise direction is different from the circumferential spacing in a counterclockwise direction.

2. The combination of claim 1 wherein the circumferential spacing between said pair of abutment ribs is approximately 160 degrees in a clockwise direction and approximately 200 degrees in a counterclockwise direction.

3. The combination of claim 2 wherein the circumferential spacing between said pair of abutment projections is approximately 160 degrees in a clockwise direction and approximately 200 degrees in a counterclockwise direction.

4. The combination of claim 3 wherein said closure cap includes a blocker bead positioned adjacent to each abutment rib, said blocker bead being constructed and arranged for blocking radially inward deflection of said abutment rib.

5. The combination of claim 2 wherein the circumferential spacing between said pair of abutment projections is approximately 180 degrees in a clockwise direction and approximately 180 degrees in a counterclockwise direction.

6. The combination of claim 5 wherein said closure cap includes a blocker bead positioned adjacent to each abutment rib, said blocker bead being constructed and arranged for blocking radially inward deflection of said abutment rib.

7. A closure cap constructed and arranged for use in combination with a container outlet which includes at least one abutment projection, said closure cap comprising an internally-threaded outer wall defining a hollow interior;

a top surface for closing one end of said hollow interior; and at least one abutment rib joined to said outer wall and including a free end which is outwardly spaced from the outer wall, said abutment rib being constructed and arranged for riding over said abutment projection during the threaded advance of the closure cap onto the container outlet and for abutting engagement against said abutment projection during retrograde rotation of the closure cap from said container outlet, said abutment rib being manually movable in a radially inward direction for taking said abutment rib out of abutting engagement with said abutment projection; and a blocker bead positioned adjacent to said abutment rib with clearance therebetween and integral with said outer wall, said blocker bead having a radial extent generally coincident with said free end, said blocker bead being constructed and arranged for blocking the radially inward deflection of said abutment rib by providing an abutment surface for whatever means are used in an attempt to radially inwardly deflect said abutment rib.

8. The combination of claim 1 wherein said closure cap includes a blocker bead positioned adjacent to each abutment rib, said blocker bead being constructed and arranged for blocking radially inward deflection of said abutment rib.

9. The combination of claim 1 wherein the circumferential spacing between said pair of abutment projections is approximately 160 degrees in a clockwise direction and approximately 200 degrees in a counterclockwise direction.

10. The combination of claim 1 wherein the circumferential spacing between said pair of abutment projections is approximately 180 degrees in a clockwise direction and approximately 180 degrees in a counterclockwise direction.

* * * * *